United States Patent [19]

Sykora

[11] 4,258,875

[45] Mar. 31, 1981

[54] CONTAINER ASSEMBLY FOR ICE-CREAM PRODUCTS

[75] Inventor: John M. Sykora, Chicago, Ill.

[73] Assignee: Field Container Corp., Elk Grove Village, Ill.

[21] Appl. No.: 32,118

[22] Filed: Apr. 23, 1979

[51] Int. Cl.[3] ..... B65D 45/18

[52] U.S. Cl. ..... 229/41 B; 229/43; 229/45 R

[58] Field of Search ..... 229/43, 37 E, 37 R, 229/39 R, 32, 41

[56] References Cited

U.S. PATENT DOCUMENTS

| | | | |
|---|---|---|---|
| 2,185,604 | 2/1940 | Moore | 229/43 |
| 2,768,777 | 10/1956 | Barrington et al. | 229/45 X |
| 3,195,798 | 7/1965 | Wilson | 229/37 R |
| 3,219,255 | 11/1965 | Holmes | 229/39 |
| 3,512,699 | 5/1970 | Wilson | 229/37 X |
| 3,520,468 | 7/1970 | Wieman | 229/45 |
| 3,958,747 | 5/1976 | Chipp | 229/45 R |

*Primary Examiner*—Davis T. Moorhead

*Attorney, Agent, or Firm*—Alter and Weiss

[57] ABSTRACT

A knock-down container assembly for packaging and containing ice-cream products wherein an articulated carton portion co-operates with an articulated cover portion through closure features which effectively lock the cover portion in place on top of the carton portion. Various protuberances or locking flaps in the carton portion co-operate with recesses or notched regions in the cover portion respectively to provide these locking features. The carton itself is constructed to contain either a standardized half-gallon volume of ice-cream products or, alternatively, is capable of containing a one-quart volume of such products, and the container is especially adapted for utilization on standard existing ice-cream product packing machinery.

25 Claims, 13 Drawing Figures

CONTAINER ASSEMBLY FOR ICE-CREAM PRODUCTS

BACKGROUND OF THE INVENTION

The present invention relates in general to packaging containers and in particular to a knock-down container assembly for packaging and containing ice-cream products.

Packaging products for containing ice-cream products such as ice-cream, ice-milk, sherbet and the like, of course have been in existance for as long as such ice-cream products have existed. Of the several varied forms of such containers, the two most widely known and used forms are the conventional half-gallon and pint rectangular packages using tongue in slot closure means and the half-gallon quart or pint cylindrical container utilizing a circular cover. Unfortunately, these two predominant types of ice-cream products packages have associated with them several disadvantages which the present invention alleviates so as to be an improvement thereon.

For example, the standard rectangular package using a tongue flap and a slotted flap with nested flaps thereunder serves to seal the ice-cream most effectively when the ice-cream container itself is full, since the nested flaps are in closed sealing proximity to the actual contents of the package. However, when the package is repeatedly opened and shut and the contents are withdrawn there is a tendency for the nested flaps to "gap" in the absence of actual ice-cream sealed against it, so as to let in air and other impurities which tend to either "crystallize" the ice-cream or have undesirable affects in the way of odor, contamination and the like on the remaining ice-cream product left in the container.

Yet additional disadvantages are encountered in the utilization of cylindrical type ice-cream product containers which are most notably utilized with "custom" ice-cream products. Further, these circular cylindrical containers are not readily adaptable to existing packaging machinery of the type most ordinarily used in the ice-cream industry, namely machinery produced by such companies as Anderson Brothers Corporation of Rockford, Illinois. Accordingly, the filling and formation operations associated with them are more costly. Because of their inefficient utilization of space in manufacturer's finished goods storage, refrigerated delivery trucks and retail display cabinets, they create increased costs in inventorying and delivery expenses. These round containers, for the most part, are not formed during the actual on-line production but rather need to be nested and are not adaptable to preformation. In cases where in-plant preformation of non-nested cylindrical containers is possible a major capital committment is necessary. Additionally, the available rectangular shaped containers of the conventional type do not have a separate cover to effectively reseal the container while the round cylindrical containers fail to utilize positive cover securement means which reduce the inadvertent separation of the cover and the carton or container portions to in turn reduce contamination of the ice-cream products contained therein. Nor do the conventional rectangular containers lend themselves to effectively reducing the crystallization process of remaining ice-cream contents in their respective containers.

With this in mind, it becomes an object of the present invention to provide an effectively sealed ice-cream product container capable of accepting standard measures of ice-cream products in the half-gallon or one-quart sizes (by retaining the standard rectangular dimensions of the container for conventional packaging machinery while other reducing the height of the container).

It is a further object of the invention to eliminate gapping of the container closure means so as to more efficiently seal the ice-cream product contents so as to reduce crystallization and contamination.

It is also an object of the present invention to provide a container assembly which is directed to and readily adaptable for in-line formation and filling on existing conventional packaging machinery in order to reduce costs associated therewith. Further, it is an object of the present invention to provide an efficient container for such products which facilitates the effort and reduces costs involved with keeping an inventory of such products as well as with shipping such products by reducing the amount of required space to keep an inventory or for shipping. In so doing it is further an object to provide such a container which stacks and stores better, which needs not be nested, and which utilizes cover means which can be formed on-line rather than requiring preformation before the packaging and shipping operation.

These and other objects of the invention shall become apparent in light of the present specification.

SUMMARY OF THE INVENTION

The present invention comprises a knock-down container form assembly for packaging and containing ice-cream products. The assembly includes a one piece knock-down rectangular carton portion as well as a one piece knock-down cover portion for attachment thereto.

The one piece knock-down carton portion comprises a front panel, a back panel and two side panels interposed therebetween. At the bottom of the carton are bottom formation means, formed by a plurality of flaps emanating from the bottom end of the front, back and side panels which, when articulated, form a bottom panel on the carton. Additionally, one or more of the front, back and side panels of the carton have carton closure means emanating at the tops of the panels for co-operation with the cover means to effectively maintain the cover portion in its closed position on top of the carton portion. This cover portion, upon articulation, has substantially the same shape rectangularly, as the top of the carton (upon articulation) so that the cover portion itself can be telescopically, yet closely, received by the carton.

The cover portion itself comprises a top panel and a plurality of cover side panels attached to this top panel. The top and side panels of the cover portion have cover closure means which co-operate with the carton closure means so as to effectively affix the cover portion to the carton portion.

In the preferred embodiment of the invention, the rectangular carton portion is preliminarily formed into a rectangular-shaped tube through carton strip connection means which fixedly juxtapose one of the side panels to one of the proximate front or back panels. This strip connection means comprises an attachment strip which is fixedly attached through adhesive affixation between the side panel and either the front or back panel. Equivalently, the cover portion is capable of being articulated into its rectangular-shape through cover strip connection means interposed between the top and side panels of the cover. These cover strip connection means comprise a plurality of cover strips which successively juxtapose the side edges of the side panels through adhesive attachment therebetween.

In this preferred embodiment, a bottom panel is formed, partially from a slotted flap emanating from one of either of the front, back or side panels and a tongue flap which is capable of being received by the slotted flap and locked thereinto. The tongue flap emanates from another of the front, back or side panels which is positioned oppositely from the panel from which the slotted flap emanates. Additionally, this bottom panel further comprises a plurality of sealing flaps which nest when the cover portion is articulated so as to be positioned between the locked tongue slotted-flaps and the bottom aperture form by the bottom ends of the front, back and side panels. In this embodiment, each of the sealing flaps emanates from the front, back or side panels not having the tongue or slotted-flaps emanating therefrom.

In one embodiment of the invention the carton closure means comprises a plurality of carton closure flaps emanating from the top ends of one or more of the front back and side panels. One or more of these closure flaps are biased downwardly over the top of the panel from which it emanates for inverted receipt of this closure flap by the cover closure means in the cover portion when the cover portion is telescopically fitted over the carton portion. Preferably, such carton closure means of this embodiment comprise a pair of closure flaps each of which emanates from the top of each of the side panels in the carton portion. Additionally, one or more of these closure flaps has release tab means attached thereto for positioning the closure flap itself closely juxtaposed to the panel from which the closure flap emanates so as to enable facilitated release of the closure flap from the cover closure means when the release tab means is activated.

In the embodiment of the invention wherein the downwardly biased closure flaps are used, the cover closure means itself comprises a plurality of recesses in one or more of the cover side panels. Each of these recesses are shaped to snugly receive each of the one or more closure flaps of the carton respectively through urging of these closure flaps into the recesses when the cover portion is telescopically fitted over the carton portion. The closure flaps thereby nest into these recesses to preclude the inadvertent and undesired removal of the cover portion from the carton portion. The previously mentioned release tabs operate, when depressed, to remove the one or more closure flaps from their respective recesses so as to dislodge the nested flaps from their positions within the recesses and in turn facilitate removal of the cover portion from the carton portion.

In this particular embodiment of the invention, wherein downwardly biased closure flaps are utilized, the invention is envisioned as further comprising yet additional carton closure means comprising a plurality of bossed ridges positioned closely proximate to the top of one or more of the front, back and side panels in order to increase the frictional fit between the telescopically received cover portion and carton portion. Preferably, these bossed ridges are positioned closely proximate to the tops of each of the front and back panels particularly. Additionally, the cover portion itself has a plurality of bossed ridges in one or more of the cover side panels to increase the frictional fit between the carton and cover portions. Indeed an embodiment of this invention calls for the utilization of such a plurality of bossed ridges on both the carton portion and the cover portion which are aligned, wherein the bossed ridges on each of these portions slide past one another upon telescopic fitment of the cover onto the carton portion so as to create a "fastening" of one bossed ridge behind the other to additionally fixedly secure the position of the cover portion onto the carton portion.

Indeed, notwithstanding what type of closure means are utilized between the carton and the cover with regard to the particular type or structural features of the closure flaps, it should be realized that such bossed ridges as previously discussed may be used to increase the frictional fit between the covering carton portions, or fasten behind one another. Thus, bossed ridges may be used on the carton portion alone, the cover portion alone, or on both the carton and cover portion to increase frictional fit involved in telescopic receipt, or, to permit the "fastening" of the bossed ridges from one element behind the bossed ridges of the other element so as to keep both elements, here the carton and cover portions, in fixed position relative to one another.

In yet another embodiment, the carton closure means comprise a plurality of closure flaps which equivalently emanate from the top of one or more of the front, back or side panels wherein the closure flaps have plurality of shear protuberances at the sides of the closure flaps which are received by the cover closure means in the cover portion when the cover portion is telescopically fitted over the carton portion. In this embodiment, the cover closure means comprises a plurality of notched regions between the cover side panels and the top panel of the cover which are aligned with the positions of the shear protuberances so as to receive these protuberances when the cover is telescopically fit onto the carton portion. By "snapping" into these notched regions and the cover portion, the shear protuberances further restrain the cover portion to the carton portion to preclude inadvertent separation therebetween. Further, in this embodiment, the shear protuberances are positioned at each of the opposing side edges of the closure flap emanating from one or more of the front, back and side panels making up the carton portion. In this embodiment also, it is envisioned that bossed ridges in both the carton and cover portions, or in only one or the other of the portions, could be utilized to improve the interference fit of the carton and cover portions or to co-operate with one another in alignment to further secure the cover portion to the carton portion.

In another embodiment of the invention, the carton closure means comprises a plurality of closure flaps which emanate from the top of one or more of the back, front or side panels. One or more of these closure flaps have a plurality of shear protuberances positioned between that flap, and the front, back or side panel from which it actually emanates. In this embodiment the cover closure means equivalently comprises a plurality of notched regions between the cover side panels and the top panel of said cover aligned with the positions of the shear protuberances so as to receive the protuberances when the cover portion is telescopically fitted over the carton portion to in turn effectively restrain the cover portion in its position of attachment to the carton portion. In the preferred version of this embodiment, the carton closure means also includes an additional plurality of protuberances which emanates from the sides of the closure flap which, upon articulation of the carton portion, become aligned with the shear protuberances emanating from the region between the closure flaps and the panel from which it is emanating.

Again, in this particular embodiment as well as its preferred version, it is envisioned to utilize a series of bossed ridges in connection with either one or the other of the cover and carton portions, as well as both.

In the preferred embodiment similarly, the carton portion comprises a standard rectangularly-shaped one-half gallon capacity container. Alternatively, the carton portion comprises a standard rectangularly-shaped one-quart capacity container. In either of the two preferred size embodiments, however the carton portion would be of such a rectangular-shape, as to be readily adaptable to the packing operation as performed on conventional ice-cream product packaging equipment.

DETAILED DESCRIPTION OF THE DRAWINGS

Figure 1:
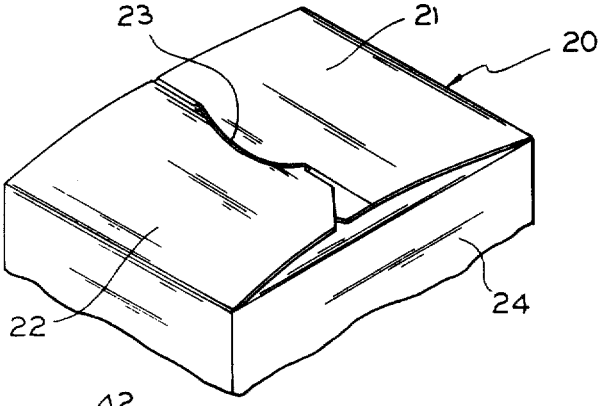
FIG. 1 of the drawings is a top perspective view of the closure means of conventional ice-cream packaging containers which utilize a tongue in groove closing construction.

While this invention is susceptible of embodiment in many different forms, there are shown in the drawings and will herein be described in detail, several specific embodiments, with the understanding that the present disclosure is to be considered as an exemplification of the principles of the invention and is not intended to limit the invention to the embodiment illustrated.

FIG. 1 of the drawings shows the conventional type of ice-cream container closure means wherein a tongue on flap 22 locks into slot 23 on flap 21. In this conventional packaging, container 20 would have comparable closure means both at the top and bottom of the container. In the present invention, the use of such a slotted and tongued flapped closing technique is confined to the bottom panel as shown by reference numerals 26 through 31 of FIG. 2.

Figure 2:
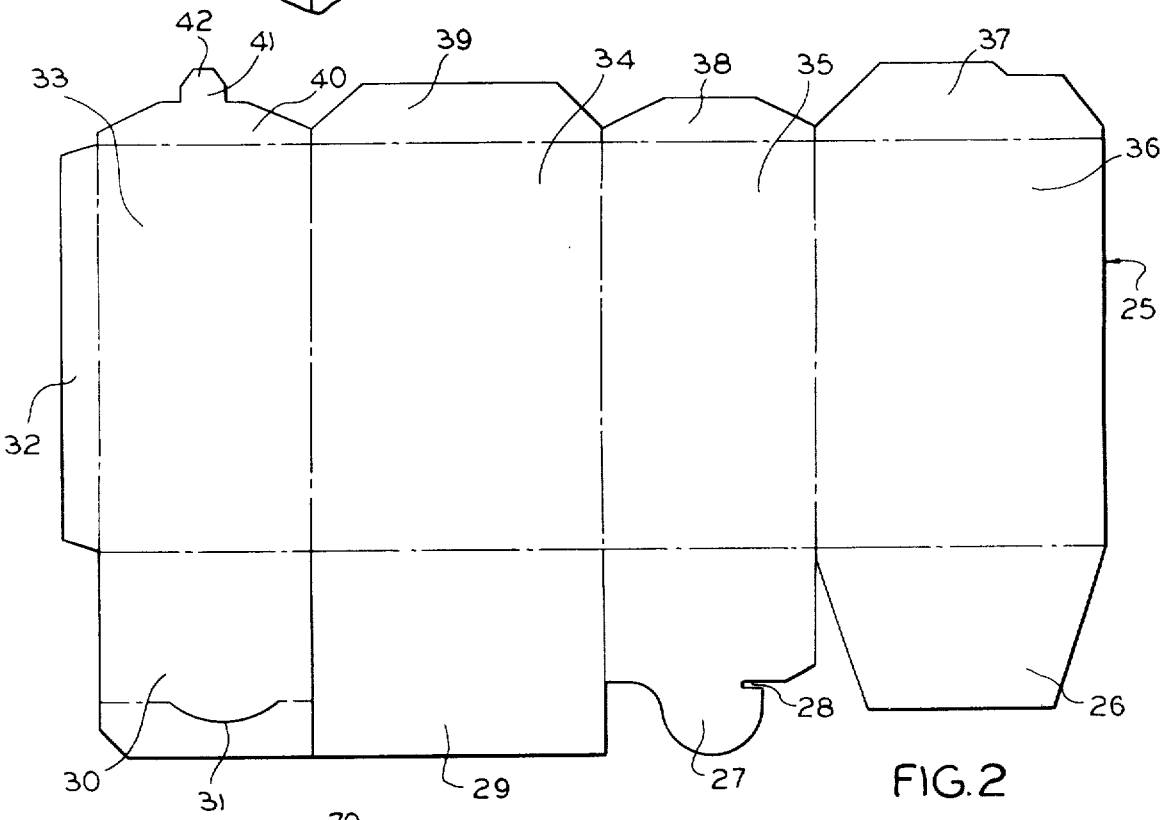
FIG. 2 of the drawing is a front elevational view of the knock-down carton blank wherein tab release means are utilized.

One embodiment of the present invention as shown in FIG. 2 wherein container 25 is shown in its unarticulated configuration as comprising a one piece knock-down rectangular carton portion. As described, the bottom panel is made up of slotted flap 30 with slot 31, and tongued flap 27 with locking notch 28 as well as sealing flaps 26 and 29 which nest together immediately inside the slotted and tongued flaps to seal the bottom aperture of the container. Sealing strip 32, through an adhesive material, fastens side 33 to front panel 36, upon articulation, to shape the carton portion into a tube before its upper and lower ends are further formed or covered. Back panel 34 and side panel 35 co-operate with panels 33 and 36 to form the rectangular carton upon articulation. Closure flaps 37, 39, 38 and 40 emanate from the front, back and side panels respectively to provide closure elements with which mated closure means in the cover portion co-operate to maintain the cover and carton portions in the sealed position. In this particular embodiment, closure flaps 38 and 40 are specifically shaped and are biased downwardly over panels 35 and 33 respectively to in turn be received and locked into recesses in the cover portion which are shown, before articulation, in FIG. 3.

Figure 3:
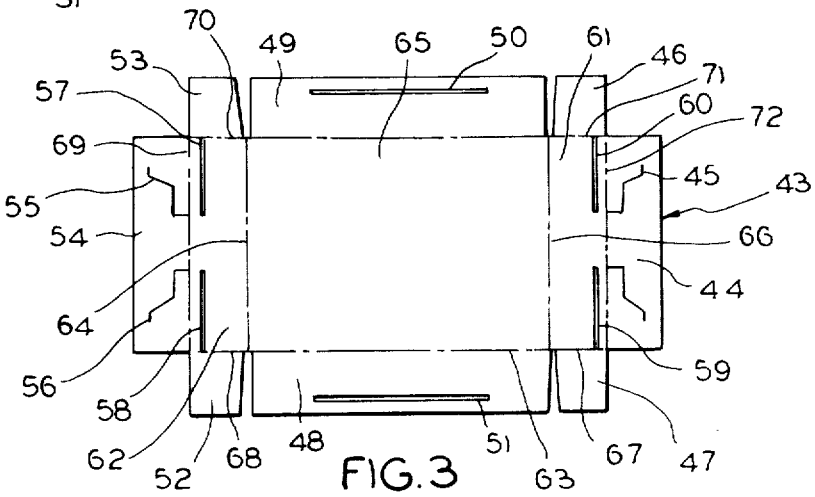
FIG. 3 is a front elevational view of the cover portion which co-operates with the carton portion of FIG. 2.

Cover portion 43 is shown in FIG. 3 before articulation as comprising top panel 65 and side panels 44, 49, 62 and 48; which are separated by folds such as folds 64 and 66 separating sides 62 and 61 from top panel 65. Cover strips 46, 47, 52 and 53 upon articulation, connect the side panels of the cover to one another in succession through the use of adhesive materials to enable connection, for example, of side 48 to side 62 at a ninety degree angle when strip 52 is adhesively attached to the interior of side 48.

Figure 4:
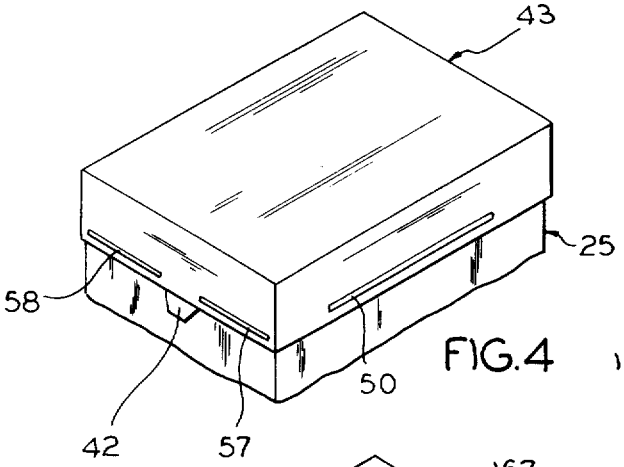
FIG. 4 is a top perspective view of the cover portion of FIG. 3 telescopically received in place upon the top of the carton portion of FIG. 2.
Figure 8:
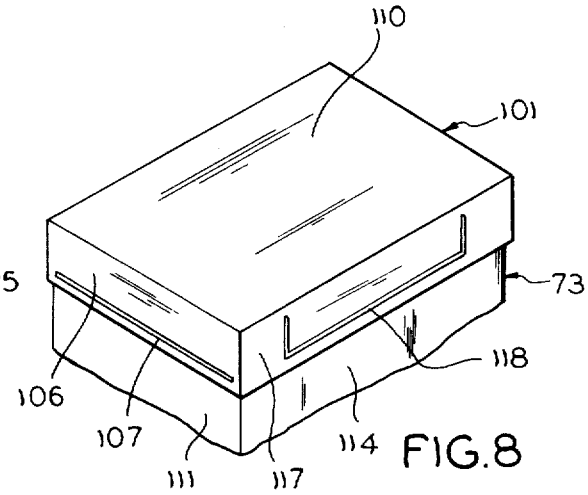
FIG. 8 is a view of the cover portion of FIG. 7 in place over the top of the carton portion of FIG. 6.
Figure 12:
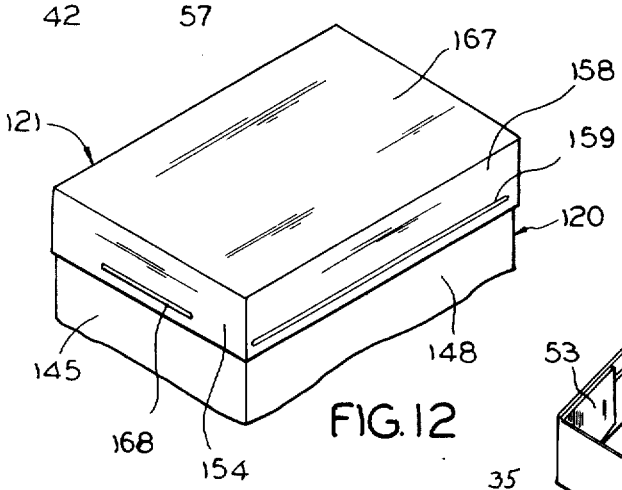
FIG. 12 is a top perspective view of the cover portion of FIG. 11 affixed to the carton portion of FIG. 10.
Figure 5:
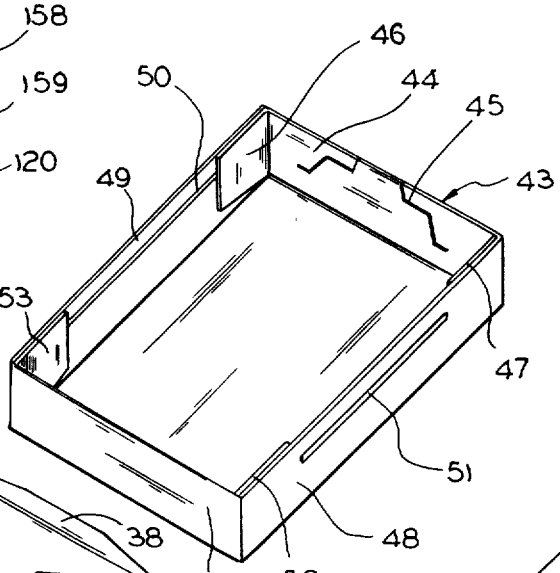
FIG. 5 is a top perspective view of both the carton and cover portions of FIGS. 2 and 3 respectively, showing particularly their closure means which co-operate to keep them in position relative to one another.
Figure 5:
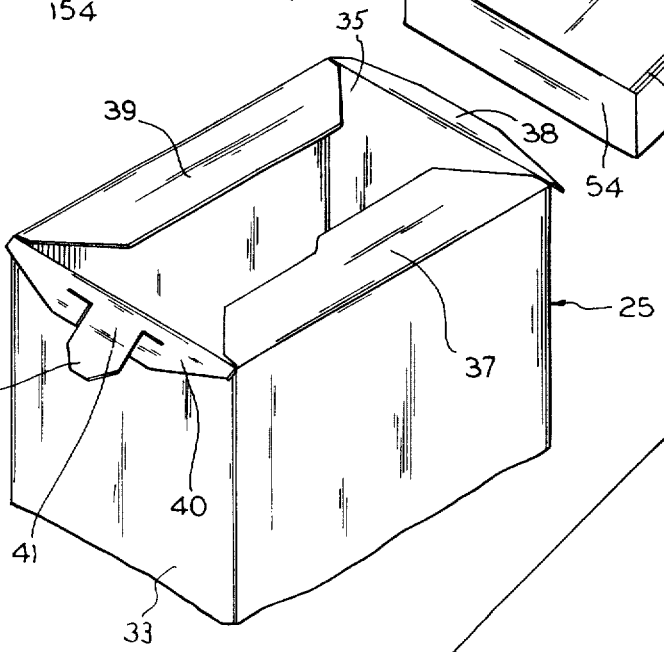

The carton and cover portions of FIGS. 2 and 3 are shown in their articulated form in FIGS. 4 and 5. Bossed ridges 57 and 58 on cover portion 43 are shown in FIGS. 3 and 4 for example as is bossed ridge 50. Through the utilization of such bossed ridges, an increased interference fit is capable of being maintained between the cover and the carton portion. Additionally, where aligned bossed ridges are utilized on both the cover and carton portions such as in FIG. 9 with ridges 116 and 200, such bossed ridges are capable of sliding past one another for interlocking therebetween. Release tab 42 is also shown in FIG. 4.

In the preferred embodiment of the invention, which is described by FIG. 5, for example, closure flap 37 and 39 on carton 25 would be folded inwardly over the ice-cream contents. Flaps 37 and 39, as do flaps 74 through 77 of FIG. 9 and flaps 122, 126, 128 and 132 of FIG. 13, additionally serve to facilitate removal of the cover from the filled ice-cream container by separating the cover portion from direct contact with the ice-cream. Conventional containers often allow the cover assembly to come into contact with the ice-cream when the container is full and in so doing increase, through adhesion, the attraction between the ice-cream and the cover to make intentional removal of the cover more difficult while at the same time dirtying the inside of the cover as well as the top surface of the ice-cream itself.

Closure flaps 38 and 40, are folded downwardly across the panels from which each of the respective flaps emanates. Closure flap 40 is folded downwardly over the upper portion of side panel 33 while closure flap 38 folds downwardly over the upper portion of side panel 35. As can be seen in FIG. 5, cover 43 is maintained in place on carton portion 25 through the telescopic receipt of cover 43 by the carton portion whereupon shaped panel 40 snaps into recess 45 described in side panel 44 of cover portion 43. Equivalently, shaped closure flap 38 snaps into an equivalent recess shaped in the interior side of side panel 54 of cover portion 43 when the cover portion is attached to the top of carton 25. Release of the cover portion is accomplished by firmly depressing release tab 42 inwardly into panel 33 which in turn removes closure flap 40 from its position within recess 45 to enable pivotal detachment of the cover portion around closure flap 38. Bossed ridges 50 and 51, also shown in FIG. 5, lend structural support to the side panels of cover portion 43, while at the same time urging a better and closer interference fit between cover portion 43 and carton portion 25. Recess 45 in side panel 44 of cover portion 43 is formed by a perforation in side panel 44 which permits the edges of recess 45 to protrude so as to form the desired recess region.

A second embodiment of the invention is shown in FIGS. 6 through 9 wherein carton portion 73 relies upon a series of shear protuberances 98, 99, 100 and 203 which cooperate with notched regions such as notched region 204.

Figure 6:
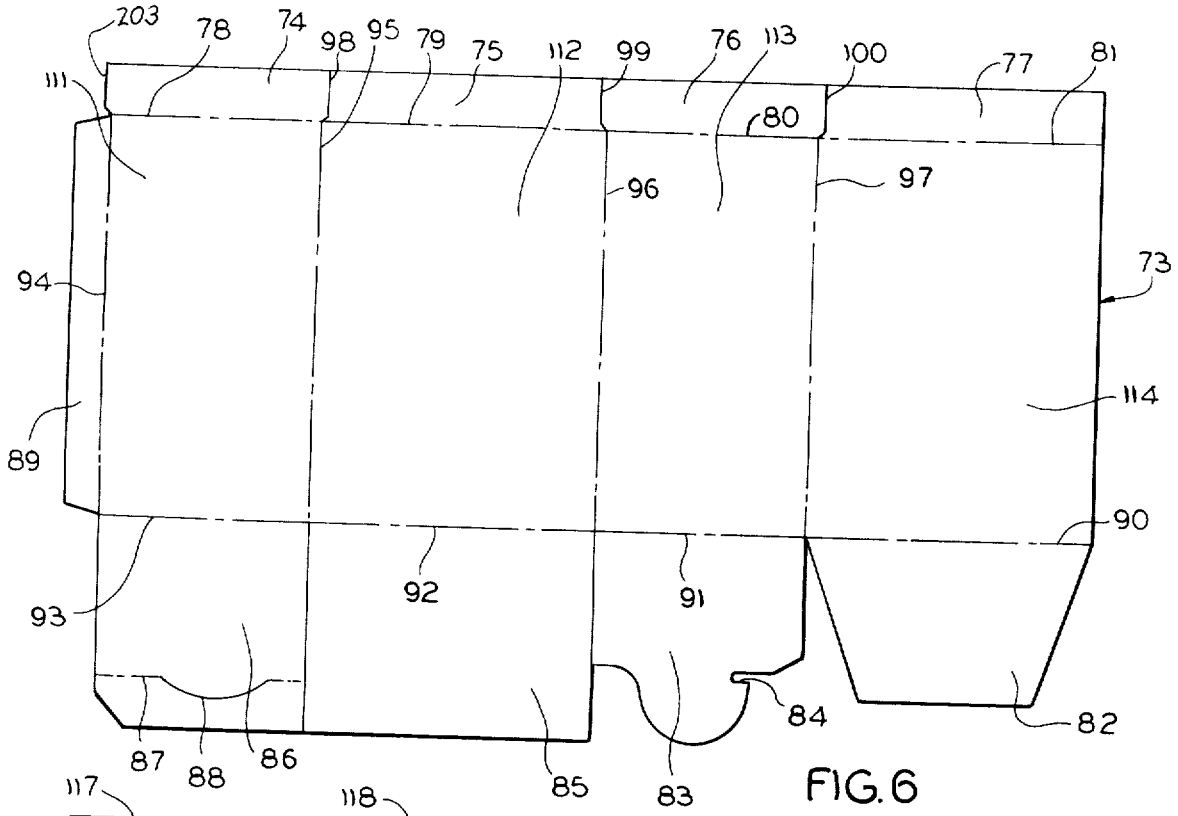
FIG. 6 is a front elevational view of an embodiment of the container in which the carton portion utilizes shear protuberances emanating from the sides of its closure flaps.

In FIG. 6 carton portion 73 can be seen to be made up of side panels 111 and 113, front panel 112 and back panel 114. Closure flaps 74 though 77 are formed at the upper portion of these respective panels and closure flap 74 and 76 have protuberances 203 and 98, and 99 and 100 respectively emanating from their sides. Fastening strip 89 connected at fold 94 to panel 111 is also shown. The bottom of carton portion 73 is made up of sealing flaps 85 and 82, tongued flap 83 having notch 84, and slotted flap 86 with slot 88 interrupting fold 87. In this particular embodiment, cover portion 101 shown in FIG. 7, has side panels 106, 109, 117 and 115 as well as fastening strips 102 through 105 which, through adhesion, permit the articulation of the cover portion blank into cover portion 101 as shown in FIG. 9.

Figure 7:
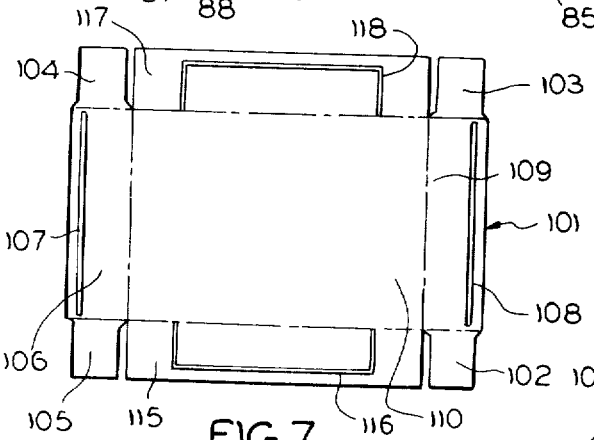
FIG. 7 is a front elevational view of the blank for the cover portion which co-operates with the carton portion of FIG. 6.
Figure 9:
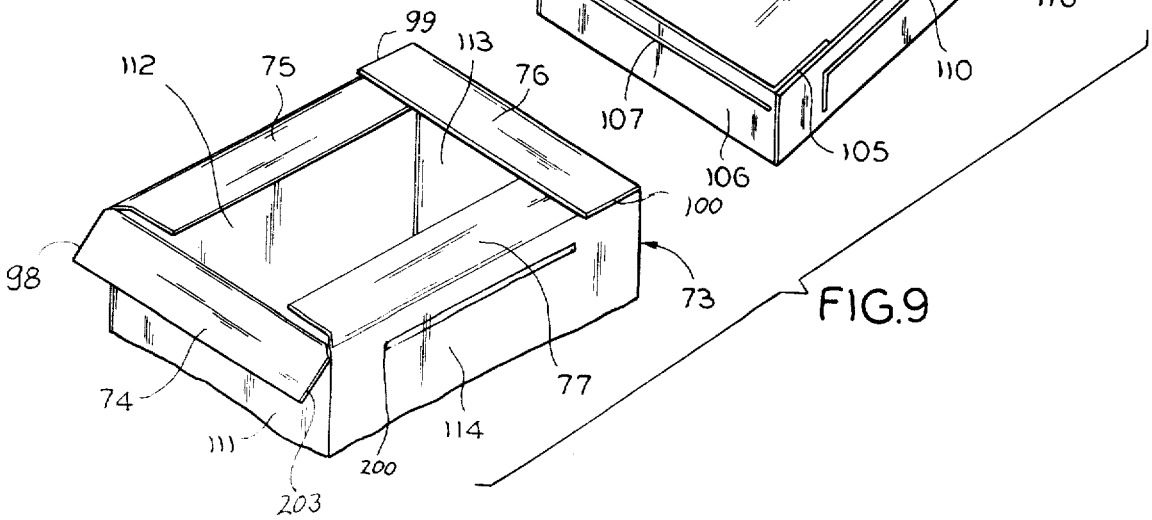
FIG. 9 is a perspective view of the carton and cover portions of FIGS. 6 and 7 respectively after articulation, showing particularly, the interior portions of carton and cover closure means.

Also shown in both FIGS. 7 and 9 are bossed ridges 116, 118, 107 and 108 for the previously mentioned improved interference fit, structural rigidity, and "snap-behind" fastening features. Bossed ridge 200 on carton portion 73 shown in FIG. 9 is thus capable of cooperating with bossed portion 116 when the cover portion is telescopically placed over the top portion of carton 73. The placement of these two bossed ridges, when aligned, enable the snapping behind of one-another so as to further securely fasten the cover portion 101 to carton portion 73. Further, in this particular embodiment, all of the closure flaps, namely closure flaps 74 through 77 are turned inwardly after the carton is packed with the ice-cream product, with no closure flaps being turned downwardly as in the previously mentioned embodiment. Upon positioning of the cover portion onto carton portion 73 the extending shear protuberances 99, 100, 203 and 98 virtually snap into notched regions such as notched region 204 which is formed by the space between fastening strip 103 and top panel 110 upon articulation. Upon positioning of all four shear protuberances into equivalently fashioned notched regions, the cover is securely fastened into place upon carton 73 requiring increased urging for removal so as to in turn guard against inadvertent separation of the cover and carton portions.

Another embodiment of the invention is shown in FIGS. 10 through 13. Carton portion 120 has side panels 145 and 147, front panel 146 and back panel 148. The bottom panel is formed by nested sealing flaps 137 and 140 tongued flap 138 and slotted flap 141. In this particular embodiment of the carton portion, closure flaps 128, 132, 126 and 122 emanate from the upper portion of the respective panels for subsequent cooperation with closure means in the cover portion. This particular embodiment further relies upon shear protuberances which preferrably, comprise a combination of two different types of shear protuberances for fastening with the notched regions in the cover portion.

Figure 10:
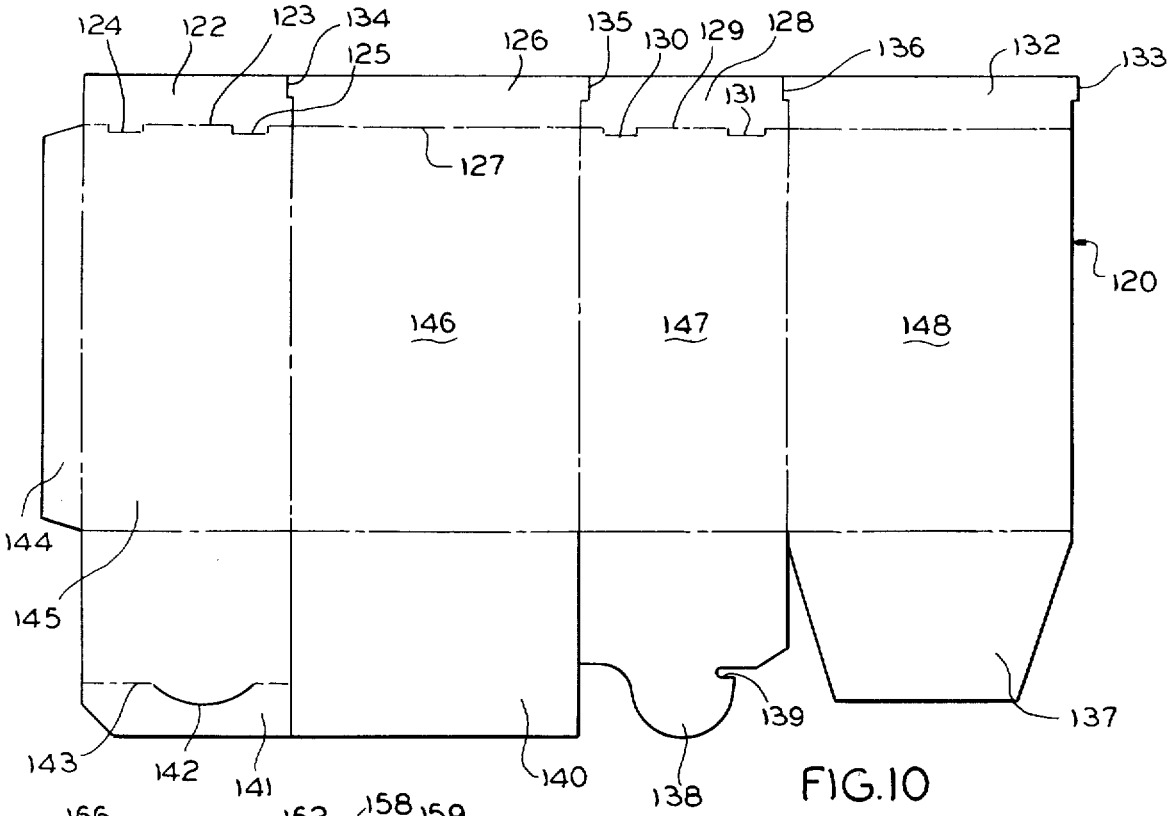
FIG. 10 is a front elevational view of another embodiment of the carton portion blank utilizing shear protuberances emanating from the boundary fold between the panel and closure flaps.
Figure 13:
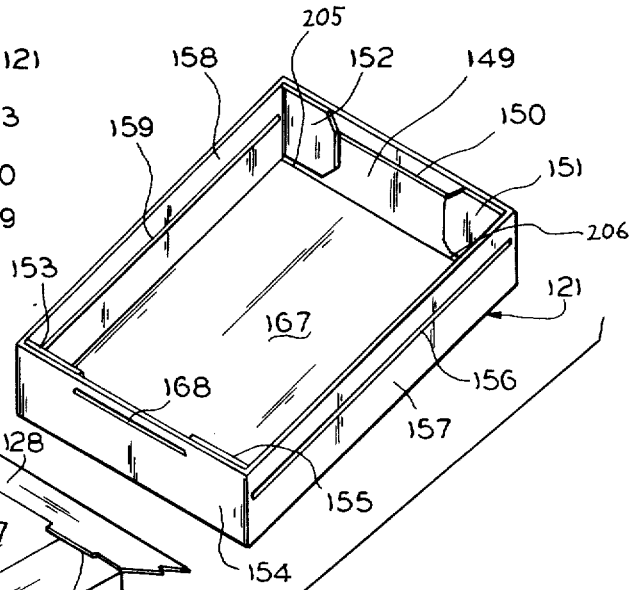
FIG. 13 is a top perspective view (after removal) showing the carton and cover portions of FIGS. 10, 11 and 12, and particularly the closure means associated therebetween.
Figure 13:
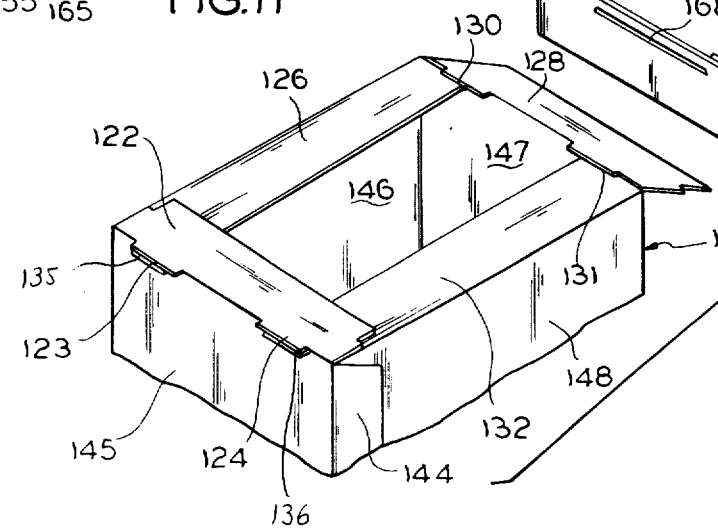

In FIG. 10 shear protuberances 124 and 125 are formed between panel 145 and closure flap 122 by cutting or perforating the packaging material to form the protuberances, which are connected by fold 123. Likewise between panel 147 and flap 128 are fabricated two protuberances 131 and 130 which emanate outwardly when the carton is articulated. In this particular embodiment, additional shear protuberances are utilized, namely protuberances 134 and 135 emanating from closure flap 126 on panel 146 and protuberances 133 and 136 on closure flap 132 emanating from panel 148. When carton portion 120 is articulated as shown in FIG. 13 the protuberances from the front and back panels namely protuberances 133 through 136 extend through the vacancies left by the other shear protuberances and align with them. In that figure, protuberance 136 is aligned with protuberance 124 and equivalently, protuberance 123 is aligned with protuberance 135 to form a reinforced series of protuberances capable of snapping into notched regions 205 and 206 in cover portion 121.

Figure 11:
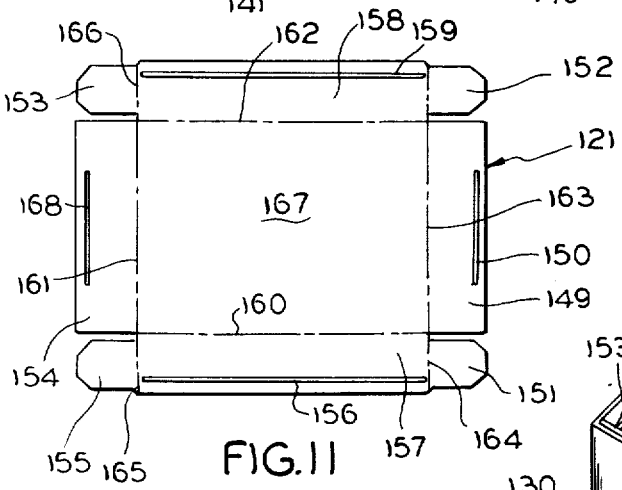
FIG. 11 is a front elevational view of the cover portion blank which co-operates with the embodiment of carton shown in FIG. 10.

Briefly, in FIG. 11 cover portion 121 is shown in its entirety as comprising top panel 167 and side panels 154, 157, 149 and 158. Strip connection panels 152, 153, 151 and 155 are also shown comprising the means for forming the side panels into an articulated cover portion. Bossed ridges 150, 156, 168 and 159 are also shown as are they shown in FIG. 13. Carton portion 120 is indeed capable of utilizing equivalently placed or aligned bossed ridges such as bossed ridge 200 of FIG. 9 for cooperation with the bossed ridges of the cover portion. Cover portion 121 is shown in place atop carton portion 120 in FIG. 12.

Through the use of such shear protuberances in this third embodiment, a close restrained fit is maintained between the cover and carton portions.

The foregoing description and drawings merely explain and illustrate the invention and the invention is not limited thereto, except insofar as the appended claims are so limited as those skilled in the art who have the disclosure before them will be able to make modifications and variations therein without departing from the scope of the invention.

What is claimed is:

1. A knock-down container assembly for packaging and containing ice-cream products comprising:

a first one-piece blank defining a knock-down rectangular carton portion and a second one-piece blank defining a knock-down cover portion for detachably fixed attachment to said carton portion;

said one-piece knock-down carton portion comprising a front panel, a back panel, and two side panels interposed therebetween;

carton bottom formation means comprising flap means emanating from the bottom of said carton portion and which, when articulated, form a bottom panel on said carton portion;

carton closure means comprising a carton closure flap emanating from the top end of one of said panels of said carton portion, said carton closure flap being folded outwardly and downwardly from the top of said one panel from which it emanates whereby substantially the entirety of said carton closure flap lies outwardly of the outer surface of said one panel when said container is assembled;

said cover portion comprising a top panel and a plurality of cover side panels immediately attached to said top panel;

said cover portion when articulated having substantially the same shape as the top of said carton portion for telescopic receipt thereover and further being continuously leakproof and free of exposing apertures therewithin to preclude inadvertent leakage of said ice-cream products; and cover closure means carried by said cover portion and comprising recess means formed in a side panel proximate said top panel of said cover portion, said cover closure means positioned contiguous said outwardly folded panel of said carton portion upon telescopic fitment of said cover portion over said carton portion, said recess means being adapted to detachably and interlockingly receive said carton closure flap.

2. The invention according to claim 1 in which said rectangular carton portion is preliminarily formed into a rectangular-shaped tube through carton strip connection means which fixedly juxtaposes one of said side panels proximate to one of said front and back panels.

3. The container assembly of claim 2 wherein said strip connection means comprises an attachment strip fixedly attached to said proximate panel through adhesive affixation.

4. The invention according to claim 1 in which said cover portion is articulated into said shape through cover strip connection means operably interposed between said top and side panels of said cover portion, said cover strip connection means comprising a plurality of cover strips which successively juxtapose the side edges of said panels through adhesive attachment therebetween.

5. The invention according to claim 1 wherein said bottom panel comprises a slotted flap emanating from one of said front, back and side panels and a tongued flap capable of being received by said slotted flap and locked thereinto, said tongued flap emanating from one of said front, back and side panels positioned oppositely from said panel from which said slotted flap emanates.

6. The invention according to claim 5 wherein said bottom panel further comprises a plurality of sealing flaps which must, when said cover portion articulated so as to be positioned between said locked tongue and slotted flaps, and the bottom aperture formed by the bottom ends of said front, back and side panels;

each of said sealing flaps emanating from the front and back and side panels opposite said tongued and slotted flaps.

7. The invention according to claim 1 in which said recess means comprises a plurality of recesses in one or more of said cover side panels, each of said recesses shaped to singly receive each of said one or more closure flaps of said carton portion respectively through urging of said closure flaps into said recesses upon said telescopic fitment of said cover portion onto said carton portion, said closure flaps thereby nesting into said recesses to preclude the inadvertent and undesired removal of said cover portion from said carton portion.

8. The invention according to claim 1 in which said carton closure means comprises a pair of said closure flaps, each of said pair of closure flaps emanating respectively from each of said side panels in said carton portion.

9. The invention according to claim 1 in which said carton closure means further comprises a plurality of bossed ridges positioned closely proximate to the top of one or more of said front, back and side panels to increase the functional fit between said carton and cover portions.

10. The invention according to claim 9 in which said bossed ridges are positioned closely proximate to the tops of each of said front and back panels.

11. The invention according to claim 1 wherein said cover portion has a plurality of bossed ridges on one or more of said side panels of said cover portion to increase the frictional fit between said carton and cover portions.

12. The invention according to claim 9 wherein said cover portion has a plurality of bossed ridges on one or more of side panels of said cover portion which are aligned with the plurality of bosses ridges in said carton portion;

said bossed ridges on each of said carton and cover portions sliding past one another upon said telescopic fitment of said cover onto said carton portion and fastening behind one another so as to additionally fixedly secure the position of said cover portion onto said carton portion.

13. The invention according to claim 1 in which said carton closure means comprises a plurality of bossed ridges closely proximate to the top of one or more of said front, back and side panels to increase the functional fit between said carton and cover portions.

14. The invention according to claim 13 in which said cover closure means comprises a plurality of bossed ridges in one or more of the side panels of said cover portion, said bossed ridges on each of said carton and cover portions sliding past one another upon said telescopic fitment of said cover onto said carton portion and fastening behind one another so as to fixedly secure the position of said cover portion onto said carton portion.

15. The invention according to claim 1 in which said cover closure means comprises a plurality of bossed ridges on said side panels of said cover portion which co-operate with one or more of said front, back and side panels of said carton portion by creation of a friction fit between said cover and carton portions to retain said cover portion in place upon said carton portion by precluding inadvertent separation therebetween.

16. A knock-down container assembly as defined in claim 1 in which said recess means is defined by perforation of said side panel of said cover portion whereby the portion of said side panel bounded by said perforation protrudes to define a pocket-like recess for receiving said carton closure flap.

17. A knock-down container assembly as defined in claim 1 comprising release tab means carried by said carton closure flap on the exterior of said carton whereby movement of said release tab means is effective to release said carton flap from engagement with said recess means of said cover portion to permit opening movement of said cover portion relative to said carton portion.

18. A knock-down container assembly as defined in claim 1 in which said carton closure means comprises a plurality of closure flaps adapted to cooperate with said cover closure means to detachably affix said cover portion to said carton portion, each of said carton closure flaps emanating from the top end of a corresponding different one of said panels of said carton portion, each of said closure flaps being folded outwardly and downwardly from the top of corresponding panel of said carton portion from which it emanates with substantially the entirety of each carton closure flap lying outwardly of the outer surface of its corresponding panel when said container is assembled, and cover closure means carried by said cover portion adapted to detachably and interlockingly receive said plurality of carton closure flaps upon said telescopic fitment of said cover portion over said carton portion so as to detachably affix said cover portion to said carton portion.

19. The invention according to claim 1 in which said carton portion is of a standard rectangular size for facilitated adaptation to conventional ice-cream product packaging equipment.

20. A knock-down container assembly for packaging and containing ice-cream products comprising:

a first one-piece blank defining a knock-down rectangular carton portion and a second one-piece blank defining a knock-down cover portion for detachably fixed attachment to said carton portion;

said one-piece knock-down carton portion comprising a front panel, a back panel, and two side panels interposed therebetween;

carton bottom formation means comprising flap means emanating from the bottom of said carton portion and which, when articulated, forms a bottom panel on said carton portion;

carton closure means comprising a first closure flap emanating from the top end of one of said panels of said carton portion, said first closure flap having a first shear protuberance positioned between it and said one panel from which said first closure flap emanates, said first closure flap in the assembled condition of said carton portion being foldable inwardly into overlying relation to the carton contents, inward folding movement of said first closure flap causing said first shear protuberance to project outwardly beyond the plane of said one panel to thereby leave a notch-like opening in the upper end of said one panel, said carton closure means comprising a second closure flap emanating from the top end of a second panel immediately contiguous said first panel, said second closure flap having a second shear protuberance emanating from the side of said second closure flap, said first and second panels being foldable about a fold line into perpendicular relation to each other to articulate said carton portion, said second closure flap being foldable inwardly into overlying relation to the carton contents when said carton portion is articulated to cause said second shear protuberance to align, overlay and reinforce said first shear protuberance;

said cover portion comprising a top panel and a plurality of cover side panels attached to said top panel;

said cover portion, when articulated, having substantially the same shape as the top of said carton portion for telescopic receipt thereover and further being continuously leakproof and free of exposing apertures therewithin to preclude inadvertent leakage of said ice-cream products;

and cover closure means carried by said cover portion and adapted to detachably interlockingly receive said first and second shear protuberances upon said telescopic fitment of said cover portion over said carton portion so as to detachably affix said cover portion to said carton portion.

21. The invention according to claim 20 in which said shear protuberances are positioned at each of the opposing side edges of the closure flaps emanating from one or more of said front, back and side panels.

22. The invention according to claim 20 in which said closure means further includes a series of bossed ridges in said carton portion and a series of bossed ridges in said cover portion, said bossed ridges in said carton portion co-operating with respectively aligned bossed ridges in said cover portion to further secure said cover portion to said carton portion.

23. The invention according to claim 20 in which said cover closure means comprises a plurality of notched regions between said cover side panels and said top panel of said cover aligned with the positions of said shear protuberances so as to receive said shear protuberances upon telescopic fitment of said cover portion over said carton portion thereby restraining said cover portion thereon said carton portion and to further preclude inadvertent removal therebetween.

24. The invention according to claim 20 in which said closure means further includes a series of bossed ridges in said carton portion and a series of bossed ridges in said cover portion, each of said bossed ridges in said portions co-operating with aligned bossed ridges to further secure said cover portion to said carton portion.

25. A knock-down container assembly for packaging and containing ice-cream products.

said assembly comprising a one piece knock down rectangular carton portion and a one piece knock down cover portion for fixed attachment thereto.

said one piece knock-down carton portion comprising a front panel, a back panel and two side panels interposed therebetween;

carton bottom formation means at the bottom of said carton portion formed by a plurality of flaps emanating from the bottom ends of said front, back and side panels which, when articulated, form a bottom panel on said carton portion, one or more of said front, back and side panels having carton closure means emanating from the top end of said one or more panels thereof for co-operation with said cover means, said cover portion when articulated having substantially the same shape as the top of said carton portion for telescopic receipt thereover, said cover portion comprising a top panel and a plurality of cover side panels attached to said top panel;

said top and side panels of said cover portion having cover closure means which co-operate with said carton closure means so as to affectively affix said cover portion to said carton portion.

* * * * *